US006390302B1

(12) United States Patent
Abrarov et al.

(10) Patent No.: US 6,390,302 B1
(45) Date of Patent: May 21, 2002

(54) METHOD AND APPARATUS FOR SEPARATING PARTICLES

(76) Inventors: Vagiz Nurgalievich Abrarov, 28 Madge Avenue, Northcliff; Sergei Dimitrievich Vaulin, 31 Buffels Road, Randpark Ext. 5, Randburg; Bojidara Grigorova, Number 6 East Lane, Sandown; James Anthony Jude Tumilty, 7B First Avenue, Rivonia, Sandton; Christian Ghislain Schmidt, 3 Oribi Street, Constantia Kloof, all of (ZA)

( * ) Notice: Subject to any disclaimer, the term of this patent is extended or adjusted under 35 U.S.C. 154(b) by 0 days.

(21) Appl. No.: 09/258,312

(22) Filed: Feb. 26, 1999

(30) Foreign Application Priority Data

| | | |
|---|---|---|
| Feb. 26, 1998 | (ZA) | 97/10731 |
| Jul. 16, 1998 | (ZA) | 98/6318 |
| Aug. 14, 1998 | (ZA) | 98/7306 |

(51) Int. Cl.[7] ..... B03C 7/00

(52) U.S. Cl. ..... 209/12.2; 209/127.4; 209/128; 209/131

(58) Field of Search ..... 209/127.1, 127.4, 209/128, 131, 12.2

(56) References Cited

U.S. PATENT DOCUMENTS

| | | | | |
|---|---|---|---|---|
| 2,689,648 A | * | 9/1954 | Maestas | 209/131 |
| 3,581,886 A | * | 6/1971 | Singewald et al. | 209/127.4 X |
| 3,720,312 A | | 3/1973 | Shook et al. | |
| 4,122,002 A | | 10/1978 | Hauskins, Jr. | |
| 4,357,234 A | | 11/1982 | Inculet et al. | |
| 4,473,452 A | | 9/1984 | Cantor et al. | |
| 4,514,289 A | | 4/1985 | Inculet | |
| 4,517,078 A | | 5/1985 | Inculet et al. | |
| 4,839,032 A | | 6/1989 | Whitlock | |
| 4,874,507 A | | 10/1989 | Whitlock | |
| 4,894,146 A | * | 1/1990 | Giddings | 209/131 X |
| 5,161,696 A | * | 11/1992 | Seider | 209/127.4 |
| 5,251,762 A | * | 10/1993 | Taylor et al. | 209/127.4 |
| 5,484,061 A | * | 1/1996 | Dunn | 209/12.2 X |
| 5,569,367 A | | 10/1996 | Betts et al. | |
| 5,772,043 A | | 6/1998 | Saveliev | |

FOREIGN PATENT DOCUMENTS

| | | |
|---|---|---|
| DE | 3213399 | 10/1983 |
| EP | 0 038 767 | 10/1981 |
| EP | 0 109 827 | 5/1984 |
| GB | 2 014 061 | 8/1979 |

(List continued on next page.)

OTHER PUBLICATIONS

Angleov, A.E. et al., "Physical Basis of Electrical Separation," *Nedra* 244–248, 1983 (translation).

Mecenjshin, A.I. et al., "Electrical Separation in High Fields," *Nedra* 92–93, 1978 (translation).

Electrostatic Separation of Granular Materials, Bulletin 603, Bureau of Mines, US Department of the Interior, p. 31, p. 70, undated.

On the Seperation of Minerals in High–Gradient Electric Fields, I.J. Lin et al., vol. 2, part B, Developements in Mineral Processing.

Mineral Processing, E.J. Pryor, 3rd Edition, Elsevier Publishings Co. Ltd., p. 586–595, 1965.

*Primary Examiner*—Tuan N. Nguyen
(74) *Attorney, Agent, or Firm*—Pennie & Edmonds LLP

(57) ABSTRACT

The invention concerns a method and apparatus for separating mineral particles according to their dielectric and/or electrophysical properties. In one practical example, rutile particles can be separated from zircon particles. In the method, the mineral particles which are to be separated are passed through a sharply non-homogenous electrical field. Particles with different dielectric and/or electrophysical properties are subjected to different forces which separate them spatially. The spatially separated particles are collected in discrete fractions.

38 Claims, 15 Drawing Sheets

FOREIGN PATENT DOCUMENTS

| | | | | |
|---|---|---|---|---|
| GB | 2 130 922 | | 6/1984 | |
| JP | 05126796 | | 5/1993 | |
| RU | 569325 | | 8/1977 | |
| RU | 612703 | | 6/1978 | |
| RU | 891155 | | 12/1981 | |
| RU | 1049105 | | 10/1983 | |
| RU | 2008976 | C1 | 3/1994 | |
| SU | 822899 | | 4/1981 | |
| SU | 986503 | | 1/1983 | |
| SU | 1315026 | * | 6/1987 | ..... 209/127.4 |
| SU | 1327969 | | 8/1987 | |
| SU | 1349794 | | 11/1987 | |
| SU | 152011 | | 8/1989 | |
| SU | 1592046 | | 9/1990 | |
| SU | 1775173 | | 11/1992 | |
| SU | 1776440 | * | 11/1992 | ..... 209/127.4 |

* cited by examiner

FORMATION OF MATERIAL PILES BETWEEN THE ELECTRODES

METHOD AND APPARATUS FOR SEPARATING PARTICLES

BACKGROUND TO THE INVENTION

THIS invention relates to particle separation according to the dielectric and electrophysical properties of the particles. In one application the invention relates to the separation of mineral particles according to their dielectric and electrophysical properties.

It is known to separate minerals using conventional electrostatic techniques in which particles are given electrostatic charges by induction or absorption of ions and electrons on the particle surface. These methods use corona discharge and other techniques. Examples of the known methods are described in, for instance, "Electrostatic Separation of Granular Materials" (Bulletin 603, United States Department of the Interior, Bureau of Mines), Russian patent specification 2008976, U.S. Pat. No. 3,720,312 and UK patent specification 2130922. While such techniques are successful at least to some degree, they have a number of serious disadvantages.

Electrostatic techniques generally require relatively high voltages (typically 15 to 60 kV) and currents (typically of the order of 10 mA). This makes the separation process not only expensive to operate but also inherently dangerous. Another disadvantage is the fact that electrostatic techniques are sensitive to ambient atmospheric conditions such as humidity and temperature. Also, the productivity of conventional electrostatic methods is generally low. Generally such methods also require screening of the electrodes from dust and other surface contaminants which can degrade the operation of the separation apparatus. As a further disadvantage, conventional electrostatic separators tend to be large and complex.

It has also been proposed previously to separate mineral particles in accordance with their dielectric properties. Examples are described in Developments in Mineral Processing (Mineral Processing Vol.2, Part B, 1979, 1168–1194), Mineral Processing (3rd edition, E J Pryor, 588–594), Physical Basis of Electrical Separation (A. E Angelov et al, Moscow, Nedra 244–248, 1983), UK patent specification 2014061, Japanese patent specification 05126796A) and U.S. Pat. No. 4,473,452. The known methods have the disadvantage that ponderomotive forces required to cause spatial separation of particles with different dielectric constants are disguised by more powerful Coulomb and mirror forces arising from electrostatic interaction and so generally cannot be used in practice.

SUMMARY OF THE INVENTION

The present invention is based generally on the phenomenon known as electroadhesion and more particularly on the recognition of the importance of applying sharply non-homogeneous electrical fields to particles which are to be separated.

Electroadhesion is an effect by which particles can be held, by electrical attractive or repulsive forces, within a field set up between electrodes of various potentials. This effect can be attained most readily with electret materials, but is not restricted to such materials. An electret is a dielectric material which possesses persistent electrical polarisation. While the dipoles generally have a random orientation, under the influence of an applied electric field between oppositely charged electrodes, the individual dipoles align themselves and develop strong polarity which persists even after the initial field is removed. Typically the dipoles only revert back to a random orientation very slowly unless some exciting impulse is applied to them.

The application of a sharply non-homogeneous electrical field to the particles which are to be separated allows the generation of weak ponderomotive forces which are not dependent on polarity. The ponderomotive forces are generally much weaker than charge related Coulomb and mirror forces, accounting for only 1% to 3% of the total forces acting on the particles.

According to one aspect of the invention, there is provided a method of separating particles according to their dielectric and/or electrophysical properties, wherein particles which are to be separated are passed through a sharply non-homogenous electrical field, in a non-liquid medium, the electrical field having a gradient exceeding $10^8$ V/m$^2$ and a divergence exceeding $10^{11}$, such that particles with different dielectric and/or electrophysical properties are acted upon by different forces which separate them spatially, and spatially separated particles are collected in discrete fractions.

Preferably the sharply non-homogeneous electrical field is one having a gradient exceeding $4\times10^9$ V/m$^2$ and a divergence exceeding $10^{12}$.

In one series of applications, relying on a combination of ponderomotive as well as Coulomb and mirror forces, the particles are passed through a sharply non-homogeneous electrical field set up between one or more DC electrodes and the sharp edge of a feeder. The particles are preferably passed through a combined, sharply non-homogeneous DC and AC electrical field. The particles may be discharged over a sharp feeder edge about which the combined field is set up. They may for instance be fed along a vibratory feeder to be discharged over a sharp edge thereof so as to fall under gravity through the combined, non-homogenous electrical field.

To ensure sharp non-homogeneity of the field and hence efficient separation of the particles, the radius of the feeder edge in these applications should be smaller than the particles. This dimension should be in the range 0,01 to 1 times the average particle diameter D, but is preferably in the range (0,01 to 0,5)D, most preferably in the range (0,01 to 0,1)D.

The feeder may be held at earth potential with a DC potential applied to a main space electrode situated adjacent the path of the particles as they are discharged from the edge of the feeder to set up a sharply non-homogeneous DC electrical field. A DC potential may also optionally be applied to a further electrode situated further than the main space electrode along the path of the particles discharged from the edge of the feeder. In this version, the particles are preferably conditioned prior to passage through the nonhomogenous DC electrical field set up by the DC electrodes in an AC electrical field created by application of an AC potential to an electrode or electrodes situated above and/or below the feeder in the vicinity of the edge.

In another series of applications, in which particles are spatially separated from one another according to their dielectric properties, the particles are passed through a sharply non-homogeneous, high frequency AC electrical field. The AC electrical field may be set up by AC electrodes which are spaced apart from one another by insulating material in an electrode support structure. The electrodes may be, but are not necessarily, arranged parallel to one another in the electrode support structure and they are typically inclined to a direction in which the particles pass through the nonhomogeneous electrical field.

The particles may be passed above or below the electrode support structure. This structure may be vibrated or the particles may be fluidised by a flow of air.

The method of the invention as summarised above is conveniently carried out in a gaseous medium, typically air.

According to a second aspect of the invention, there is provided an apparatus for separating mineral particles according to their dielectric and/or electrophysical properties, the apparatus comprising means for generating a sharply non-homogeneous electrical field having a gradient exceeding $10^8$ V/m$^2$ and a divergence exceeding $10^{11}$, feed means for feeding mineral particles which are to be separated through the electrical field such that particles with different dielectric and/or electrophysical properties are acted upon by different forces which separate them spatially, and spatially separated particles are collected in discrete fractions, and collection means for separately collecting the spatially separated particles.

Various further features of the method and apparatus summarised above are described below and set forth in the appended claims.

In one practical embodiment of the method and apparatus of the invention, particles of rutile ($TiO_2$) can be separated from particles of zircon ($ZrSiO_4$).

BRIEF DESCRIPTION OF THE DRAWINGS

The invention will now be described in more detail, by way of example only, with reference to the accompanying diagrammatic drawings in which.

DESCRIPTION OF EMBODIMENTS

Reference is made firstly to the series of embodiments illustrated in FIGS. 1 to 7 of the accompanying drawings.

Figure 1:
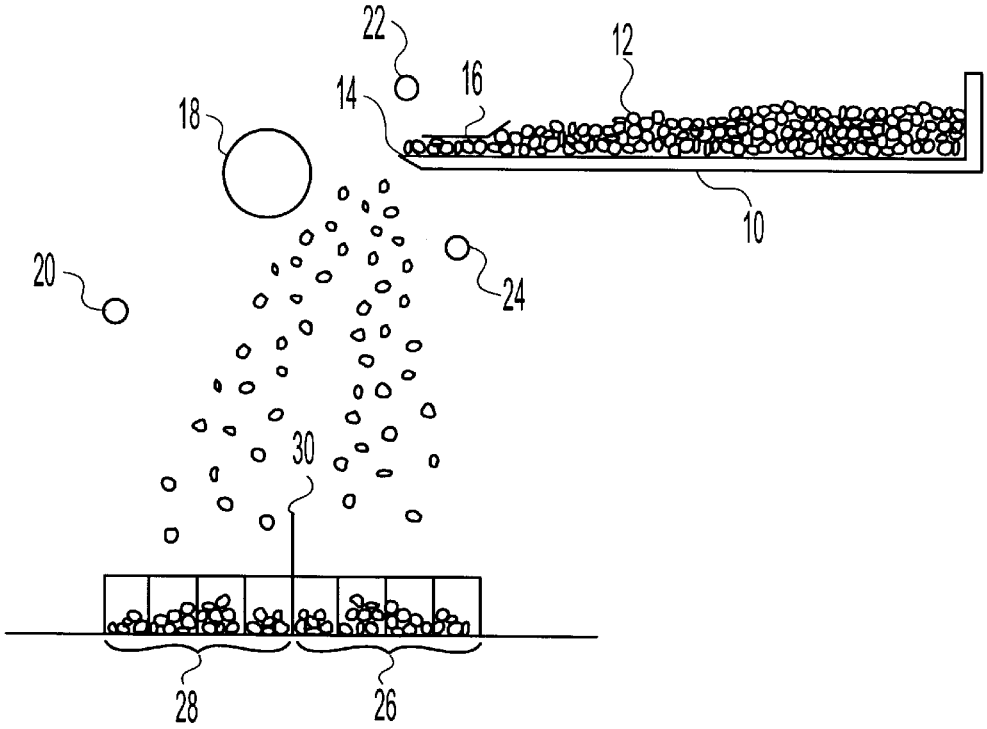
FIGS. 1 to 7 illustrate a first series of embodiments of the invention.

FIG. 1 shows a metal vibratory feed tray 10 which is held at earth potential. The numeral 12 indicates particulate material which is to be separated into, for example, rutile-rich and zircon-rich fractions. The material 12 discharges from the feed tray 10 over a sharp edge 14 after passing beneath an element 16 which forms the material flow into a thin layer, possibly a monolayer.

Located adjacent to the edge 14 of the feed tray 10 is a main space DC electrode 18 which is typically sheathed in a dielectric cover, which may be of an appropriate plastic material. The apparatus also includes a further, extended DC electrode 20 spaced further away from the edge 14. The latter electrode is also sheathed in a cover. Located above the edge 14 is an electrode 22 which is operated both in DC and AC mode. Below the edge is an electrode 24 which is also operated in both DC and AC mode.

An array of collection bins 26 and 28, separated by a splitter 30, is located some distance beneath the edge 14 as illustrated.

In operation, the vibratory feed tray 10 feeds the particulate material 12 at constant speed to the sharp edge 14. After passing over the edge, the material falls under gravity towards the bins 26, 28. A DC electrical field is set up between the DC electrodes 18 and 20 and the edge 14. The sharpness of the edge ensures that the DC field which is set up is sharply non-homogenous in nature. As mentioned previously, for particles of average diameter D it is preferred that the transverse, i.e. vertical, dimension of the edge 14 should be in the range (0,01 to 1)D but is preferably in the range (0,01 to 0,5)D and most preferably in the range (0,01 to 0,1D). In other words it is generally preferred that the radius of the edge be less, preferably considerably less, than the average diameter of the particles which are to be separated.

A high frequency AC field, typically with a frequency in the range 1 kHz to 100 kHz, is simultaneously set up between the electrodeS 22 and 24, in their AC mode of operation, and the tray 10. Thus the particles of the material 12 pass through a combined, sharply non-homogeneous DC and AC field set up between the respective electrodes and the sharp edge 14. The high frequency AC field set up between the AC electrodes and the feeder tray functions firstly to neutralise any triboelectric charges acquired by the particles as a result of friction during their passage over the feed tray 10, and secondly to impart similar electrical charges to particles of similar composition.

The sharply non-homogeneous field set up between the DC electrodes and the edge 14 results in different forces acting on particles with different dielectric and/or electrophysical characteristics. The different ponderomotive forces, combined with charge related Coulomb and mirror forces acting on the particles, give rise to different, resultant force vectors acting on the particles, holding them up in the electrical field to a greater or lesser degree depending on those characteristics. The differential forces result, as the particles fall, in spatial separation of the particles which therefore fall along different paths into different bins 26, 28.

The invention as described above may for instance be used to separate rutile particles from zircon particles. In this case the method results in spatial separation of the rutile particles from the zircon particles. The good electret properties of the rutile particles result in such particles acquiring both stable high volume charge and residual polarisation in the combined AC/DC field. The strongly charged rutile particles are accordingly held up to a greater degree in the field and tend to fly towards the DC electrodes 18 and 20 and are eventually collected in the rutile collection bins 28. In this application it is also observed that the rutile particles undergo processes of agglomeration under the AC electrode 22, and disagglomerate shortly before reaching the edge 14.

The zircon particles, on the other hand, acquire a far smaller electrical charge than the rutile particles, and their interaction with the DC field is accordingly less than in the case of the rutile particles. The gravitational effects on these particles are accordingly more influential and cause the particles to fall, more sharply than the rutile particles, into the zircon collection bins 26.

Laboratory tests indicate that a measure of rutile/zircon separation can be achieved by electro-adhesion effects using a single DC electrode 18 and with no superimposed AC field. The efficiency of the separation process in this case was seen to be better than that achieved by conventional electrostatic techniques. For instance, the electroadhesive basis of the invention was found to be capable of increasing rutile concentration in a certain sample by a factor of approximately three whereas a conventional electrostatic separation process was found to be able to increase rutile concentration in a similar sample by a factor of about 1,83 only.

The superimposition of the AC field on the DC field in accordance with the present invention considerably increased the rutile concentration, approximately four-fold, after a single separation stage. A repetition of the separation stage increased the rutile concentration even further. These results indicate the importance of having combined DC and AC fields. It is believed that even better rutile concentrations would also be achievable if the technique of the invention were combined with a prior magnetic separation process to remove ferrous impurities such as $Fe_2O_3$.

In the tests referred to above the electrode 22 was operated in AC mode only.

Tests were also conducted on a simpler form of the apparatus having a combined DC/AC field but only a single DC electrode 18 as opposed to two DC electrodes 18, 20. In this case it was found that rutile particles tended to remain held up in the vicinity of the single electrode 18 with the attendant possibility of their falling into the bins 26 and polluting the zircon concentrate. The provision of the further DC electrode 20 resulted in a better distribution of the airborne rutile particles, and hence better spatial separation of these particles from the zircon particles. The DC electrode 20 can accordingly be considered to apply an extended DC field to the rutile particles to achieve a greater spatial separation thereof and to ensure that they report to the rutile concentrate bins 28.

The tests referred to above indicated that considerable flexibility in the separation process can be achieved by appropriate selection of the operating parameters of the electrode 24. In general it was preferred to operate the electrode, in the AC mode, at a voltage not exceeding the DC voltage of the main electrode 18 and at an amplitude sufficient to cause some agglomeration of the particles during their movement on the tray 10, such that the agglomerates then break up as they separate from the edge 14. The electrode 24 was operated, in AC mode, with a much lower AC frequency than the electrode 22 in AC mode.

Further flexibility in the separation process was found to be possible by varying the polarity of the electrode 24, in DC mode, relative to the polarity of the main DC electrode 18. It was also found during testing that the voltage on the electrode 20 should optimally be about twice that of the main electrode 18 and at corresponding polarity.

In the tests referred to above, the zircon concentrations which were achieved after two successive separation stages were better than those achieved by two successive stages of the conventional electrostatic method, and considerably lower levels of rutile and other contamination were detected. This once again illustrated the efficiency of the method proposed by the present invention.

It is pointed out that the various electrodes 18, 20, 22 and 24 are preferably sheathed in insulating material, i.e. material of high dielectric constant, to prevent charging of the particles by conduction in the event of direct contact between the particles and the electrodes.

Apart from more efficient separation as exemplified above, the method of the present invention exhibited several other advantages when compared to a conventional electrostatic separation method:

1. Compared to voltage levels of 15 to 60 kV. in electrostatic methods, the invention required a voltage range of only 1 to 6 kV.
2. Compared to current levels of 15 to 30 mA in electrostatic methods, the invention required only very low currents, typically in the range 0,1 to 2 $\mu$A.
3. Compared to power consumption levels in the range 0,5 to 1.8 kW in electrostatic methods, the invention required extremely low power consumption in the DC circuit.
4. In the conventional electrostatic methods, it is necessary to screen the electrodes to prevent contamination whereas the present invention does not depend on the contamination or otherwise of the electrodes.
5. Conventional electrostatic separators tend to be large and complicated with numerous moving parts. A separator according to the present invention can be considerably more compact.
6. The method of the present invention is less sensitive to air humidity and temperature than the conventional electrostatic method.

Figure 2:
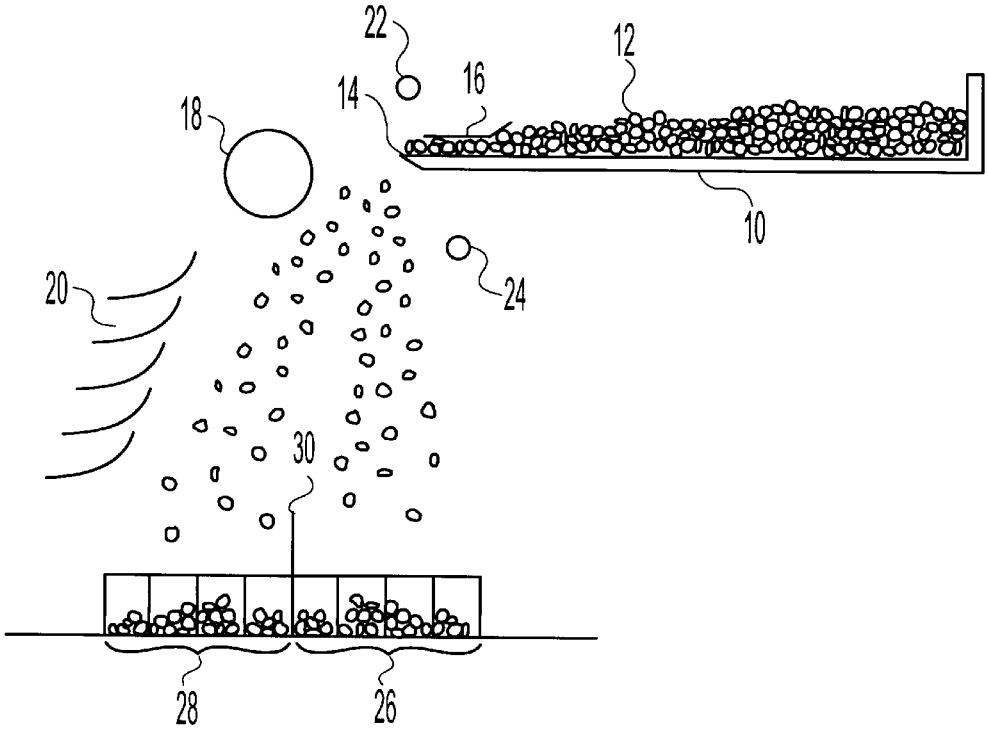

FIGS. 2 to 7 illustrate other embodiments of the invention which operate in accordance with the same principles as the embodiment of FIG. 1. In FIG. 2 the single electrode 20 is replaced by a series of vertically spaced, curved electrodes. These curved electrodes improve the function of the single electrode 20, i.e. the creation of an extended DC field to achieve enhanced spatial separation of the particles.

Figure 3:
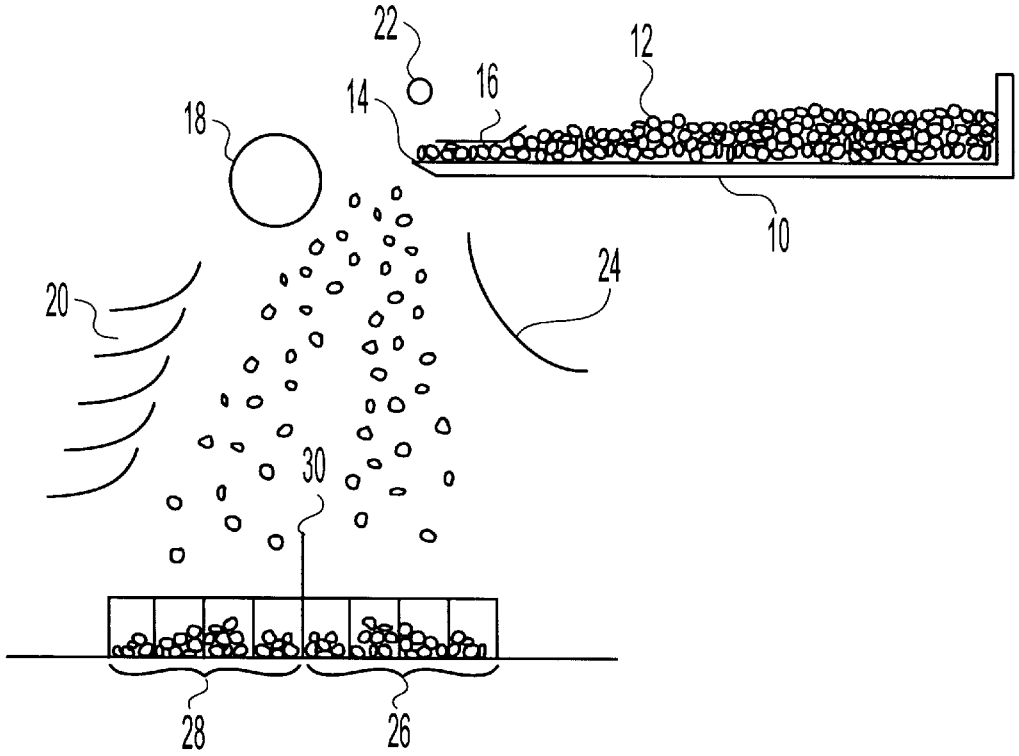

In FIG. 3 the electrode 24, which may be referred to as a "cleaning" electrode, is replaced by a curved electrode. It is anticipated that the action of this electrode will be enhanced with the illustrated, curved shape.

Figure 4:
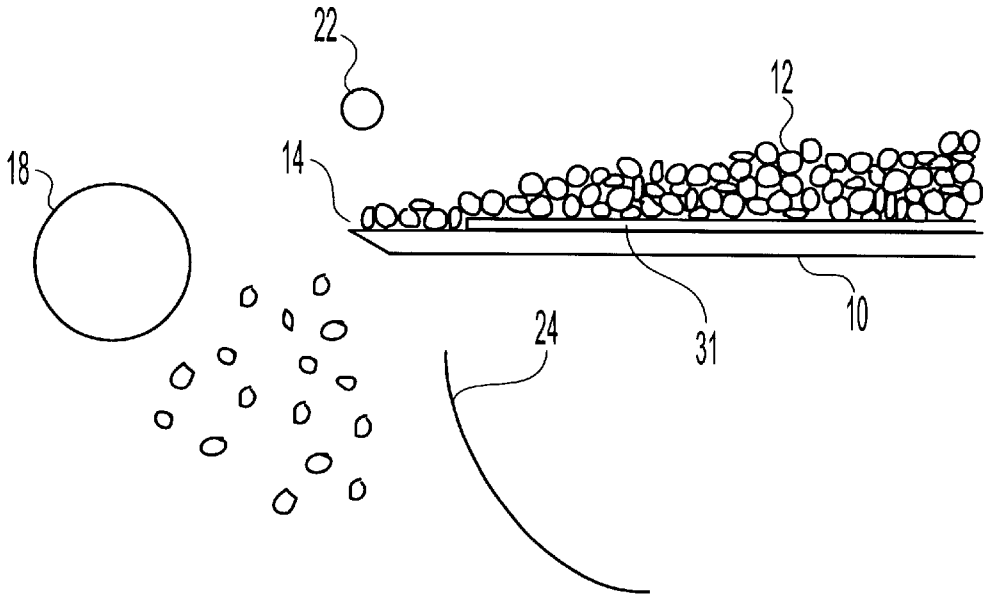

FIG. 4 shows that a layer of insulating material 31 can be located on the base of the feed tray 10 to insulate the feed material from the tray. The insulation prevents the electrical charges, which are acquired by the particles as a result of frictional forces and redistribution of charges by the applied field during material feeding, from discharging the earthed tray. The particles accordingly maintain their triboelectric charges which are utilised in the subsequent separation technique.

Figure 5:
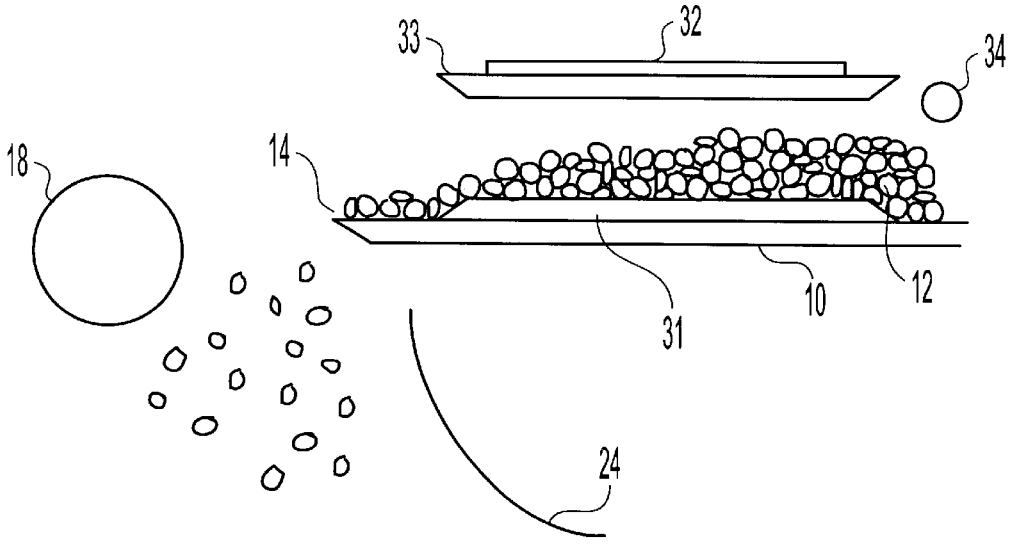

In FIG. 5 the AC/DC electrode 22 is replaced by an AC/DC plate electrode 32 which is combined with a layer 33, made of material with a high dielectric constant, located between the electrode 32 and the tray 10. This material achieves a more effective distribution of the electrical field between the electrode 32 and the tray 10 and enables charging of the particles in multiple layers, as opposed to the preferred monolayer in previously described embodiments. In addition to the AC/DC electrode 32 there is also a further AC electrode 34 above the tray 10.

Figure 6:
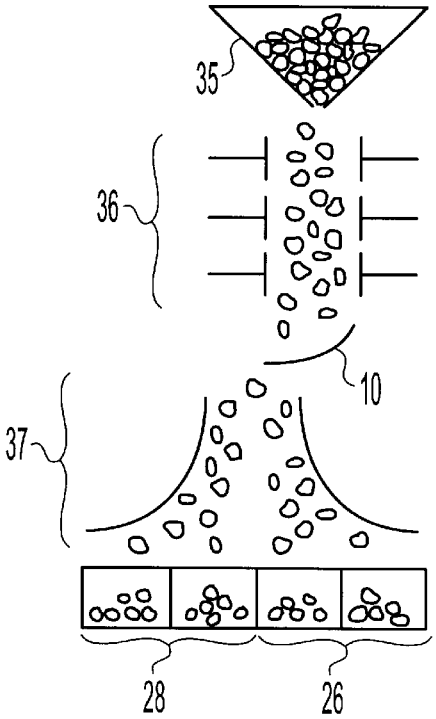
Figure 7:
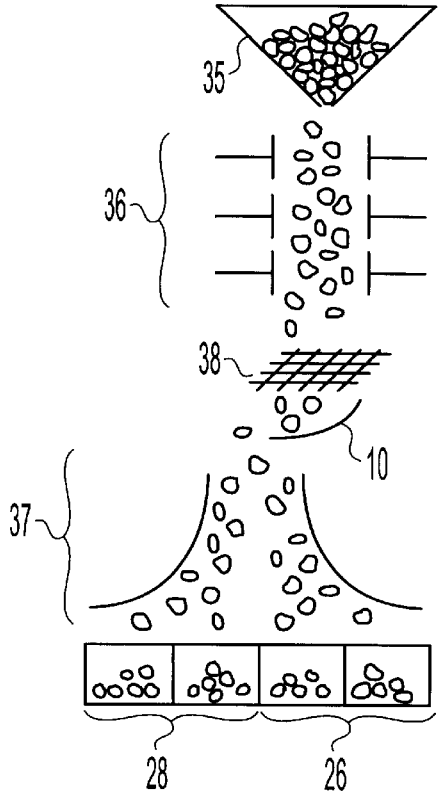

FIGS. 6 and 7 illustrate embodiments in which the particles fall freely from a primary feeder 35 through a system of combined AC and DC electrodes, indicated by the numeral 36, which impart desired charges to the particles. The particles are then discharged over the sharp edge of a feeder 10, corresponding to the feeder vibratory feeder of previous embodiments, to a zone 37 in which they are exposed to a sharply non-homogeneous DC electrical field or combined DC/AC field which corresponds to that created by the electrodes 18, 20, 22 and 24 described above.

The embodiment of FIG. 7 differs from that of FIG. 6 in that the free-falling particles are obliged to pass through a mesh 38 before reaching the feeder 10. The mesh 38 serves to break up any particle agglomerations.

Reference is now made to the second series of embodiments of the invention, illustrated in FIGS. 8 to 26, in which particles are separated spatially from one another in a sharply non-homogeneous, high frequency AC electrical field, and to FIGS. 27 to 31 which illustrate the underlying principles in this series of embodiments.

In FIGS. 8 to 26, the AC electrical field which is used typically has a high frequency in the range 1 kHz to 100 kHz.

Figure 8:
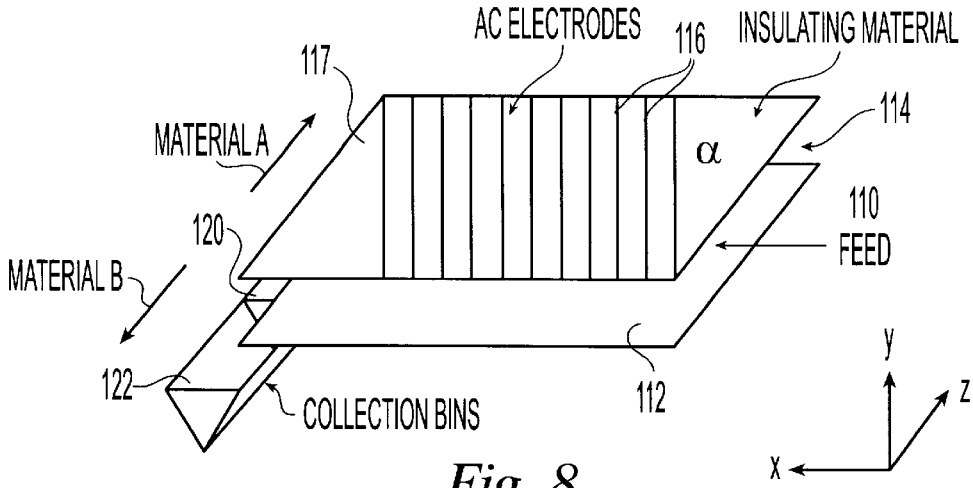
FIGS. 8 to 26 illustrate a second series of embodiments of the invention.

In the embodiment of FIG. 8 particulate material 110 which is to be separated is fed on a vibrating feeder tray 112. An electrode assembly 114 is located above the tray 112. The assembly 114 comprises a number of conducting AC electrodes 116 mounted in a plate-like electrode support structure 117 made of insulating material. With reference to the axes x, y and z, the electrodes 116 are inclined, in the x–z plane, at an angle $\alpha$ to the direction in which the material 110 is fed on the tray 112. Corresponding electrodes (not illustrated) are provided in the tray. As a less preferred alternative the tray 11 may be held at earth potential.

The electrical field set up by the alternating current applied to the electrodes 116 creates ponderomotive forces which tend to move those particles with a higher dielectric constant, designated as material A in the FIG., in a direction along the electrodes, i.e. transversely to the feed direction. Particles with a lower dielectric constant are designated in the FIG. as material B. The ponderomotive forces generated in these particles are smaller than those generated in the particles with high dielectric constant, and so continue moving generally in the feed direction. There is accordingly a separation of the particles in the z-direction. At the end of the tray materials A and B, i.e. particles with higher and lower dielectric constant respectively, are collected separately in bins 120 and 122.

Figure 27:
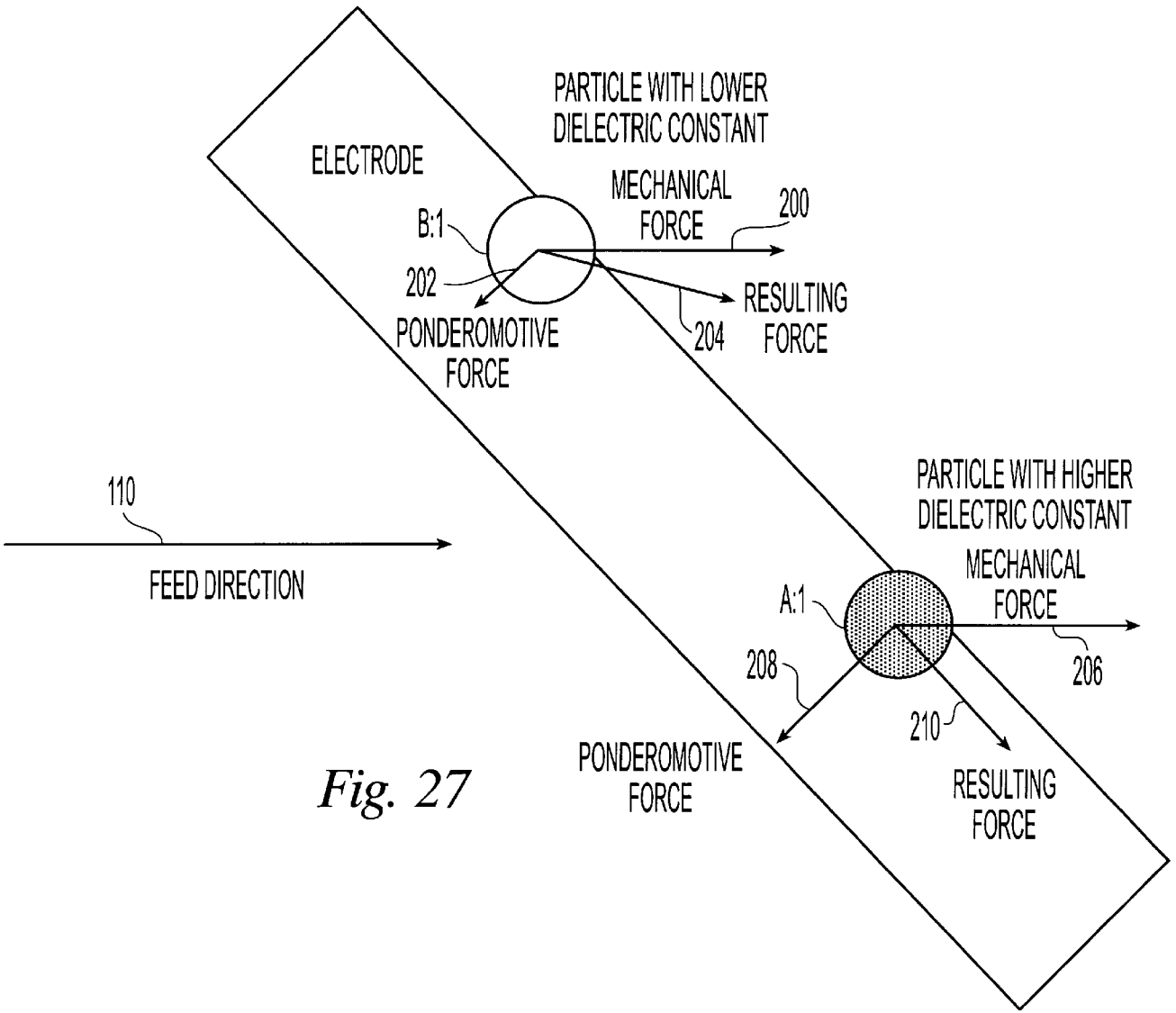
FIGS. 27 to 31 show details illustrating the methodology of the invention as applied to the second series of embodiments.

The principles underlying the differential movements of the particles of materials A and B are now explained in more detail with reference to FIG. 27. FIG. 27 shows a single electrode 116 inclined to the feed direction of the material 110. The mechanical force acting on a particle B.1 of material B is indicated as a vector 200, the ponderomotive force acting thereon as a vector 202 and the resulting force as a vector 204. Because particle B.1 has a lower dielectric constant, the ponderomotive force acting on it is relatively small. The resulting force, represented by vector 204, is accordingly not markedly inclined to the initial feed direction.

Referring to a particle A.1 of material A, having a higher dielectric constant, the mechanical feed force is represented by a vector 206 which is the same as the vector 200. However in this case the ponderomotive force on the particle A.2, represented by vector 208, is considerably greater than the ponderomotive force on the particle B.1, with the result that the resulting force, represented by the vector 210, deviates markedly from the initial feed direction and generally follows the inclination of the electrode 116 itself. The greater deflection of the particles of material A, combined with the vibration of the tray 11, results in spatial separation of the materials A and B and allows the respective particles to be collected separately in the bins 120, 122.

Figure 28:
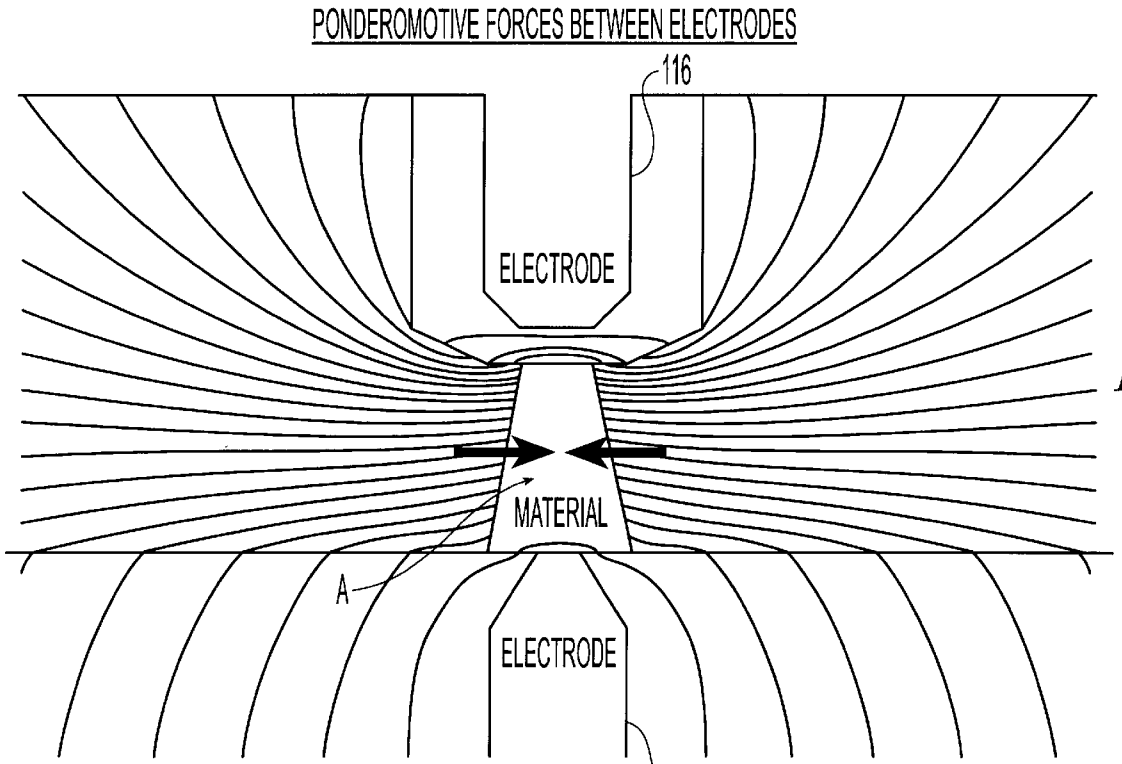
Figure 29:
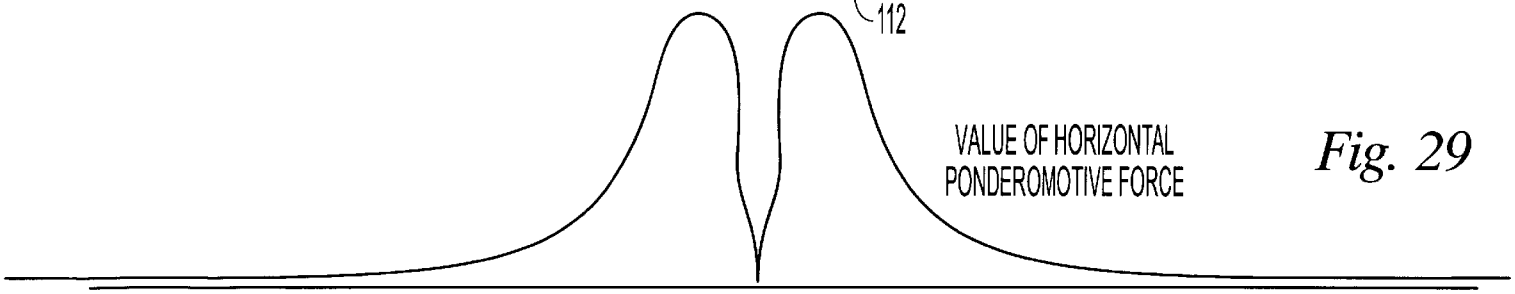
Figure 30A:
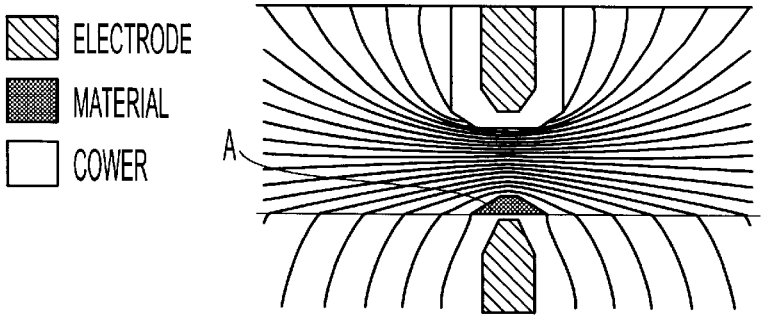
Figure 30B:
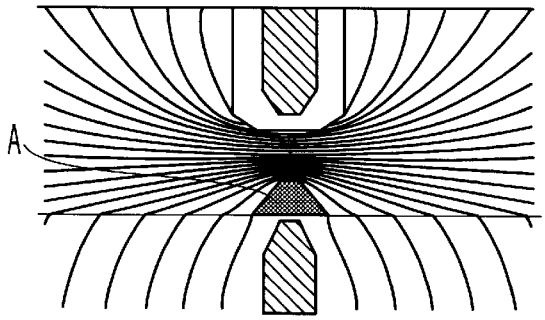
Figure 30C:
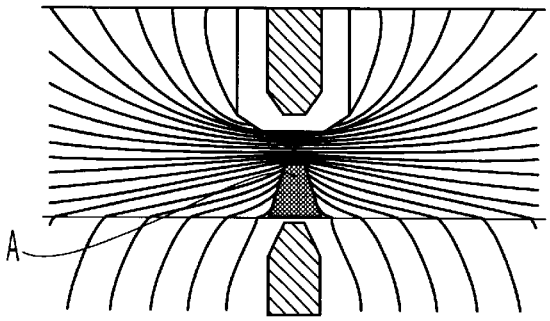
Figure 30D:
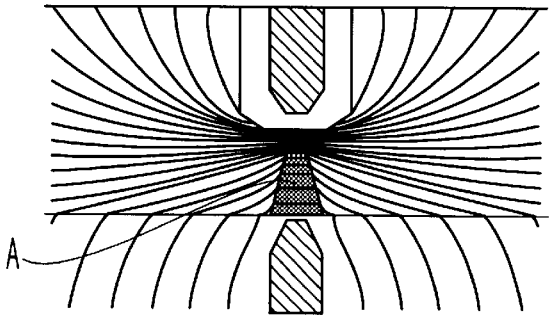
Figure 30E:
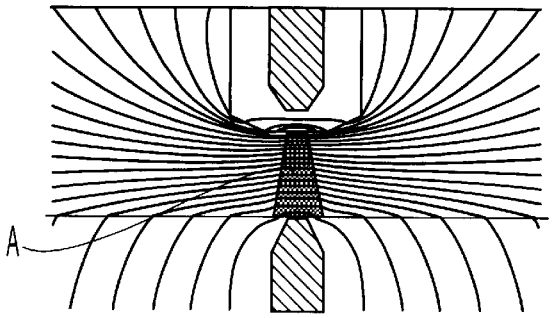

FIGS. 28 and 29 diagrammatically illustrate the electrical flux between two electrodes namely the electrode 116 and the tray 112 in FIG. 8. In FIG. 28 it will be seen that sharply non-homogeneous nature of the electrical field increases the flux directly between the electrodes, with the result that the particles of higher dielectric constant, i.e. those in material A, tend to accumulate adjacent the electrode 116. This is farther explained with reference to FIG. 29 which graphically depicts the magnitude of the laterally acting ponderomotive force for the arrangement of FIG. 28. The magnitude of this force is greatest at positions adjacent the electrode 116, resulting in the above-described accumulation of particles of material A in this region.

It will be understood that the agitation which is applied to the particles by the vibration of the tray 112 assists in moving the particles with higher dielectric constant along the electrodes and hence prevents agglomeration and piling up of the particles directly beneath and in the vicinity of the electrodes.

Figure 9:
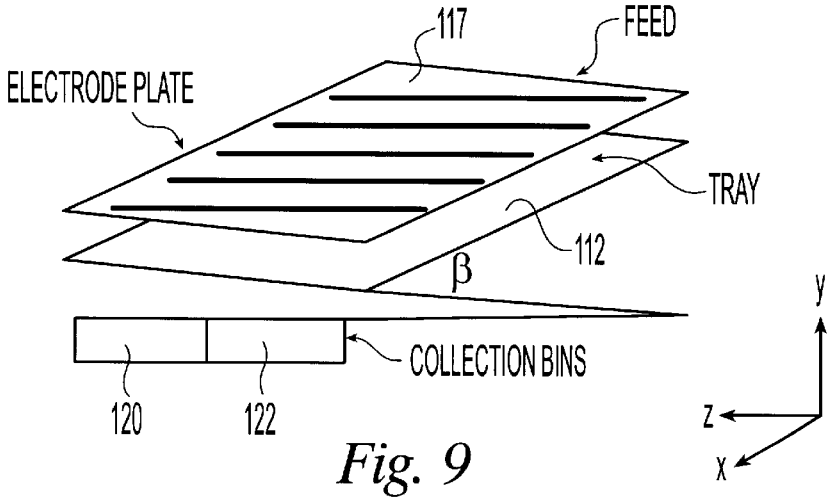

In the embodiment illustrated in FIG. 9, the structure 117 which supports the electrodes 116 forms an angle $\beta$ with the horizontal. Thus in this case gravitational forces tend to keep the particles with lower dielectric constant moving in the feed direction on the vibrating feeder tray 112. Apart from this the FIG. 9 embodiment works in the same way as the FIG. 8 embodiment.

Figure 10:
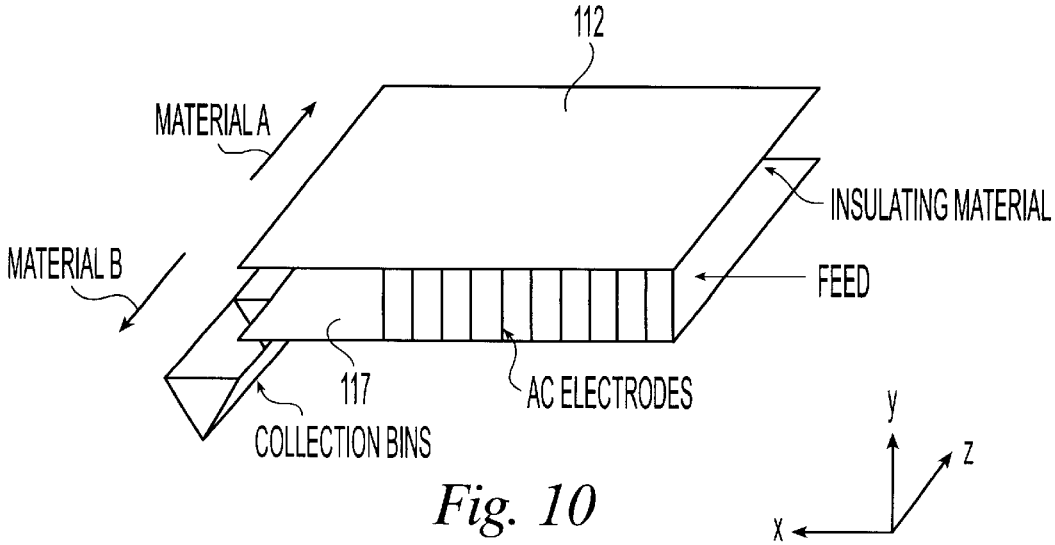

In FIG. 10, the electrode support structure 117 is located beneath the feeder tray 112 as opposed to above it as in the earlier embodiments.

Figure 11:
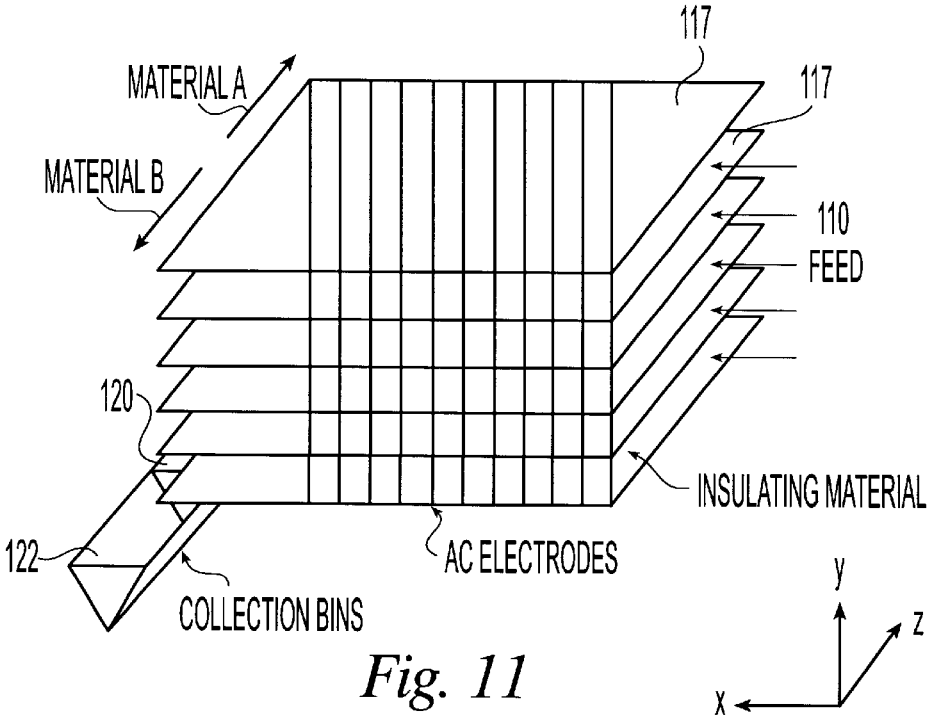

In FIG. 11, there is a stack of electrode support structures 117 between which the particles are fed. The multiplicity of electrode support structures provides for an increased throughput of material which is to be separated.

Figure 12:
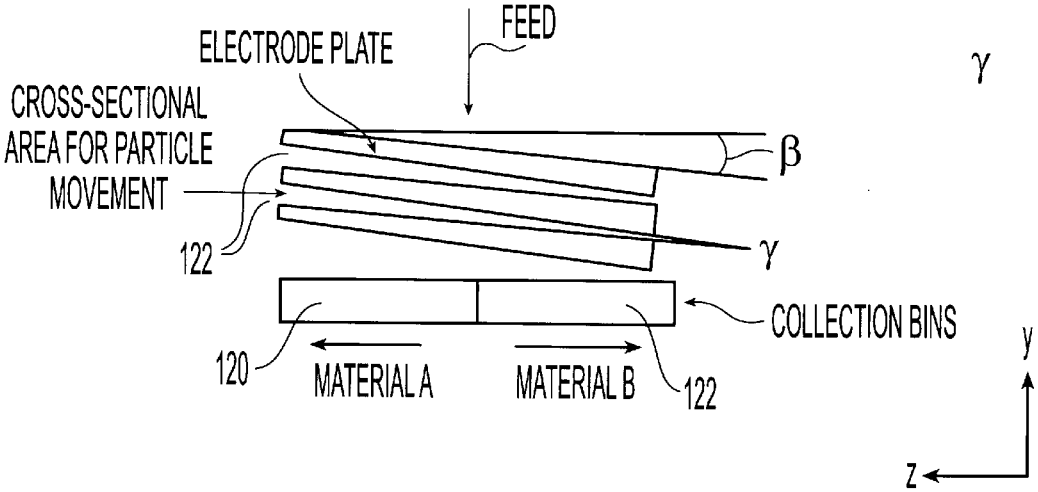

In FIG. 12, in which the apparatus is seen in cross-section, the electrode support plates have tapering shapes in cross-section and are arranged as illustrated to form gaps 124 which taper at an angle $\gamma$ and in which the particles move. As in FIG. 9, the electrode support structures are inclined generally at an angle 13 to the horizontal.

Figure 13:
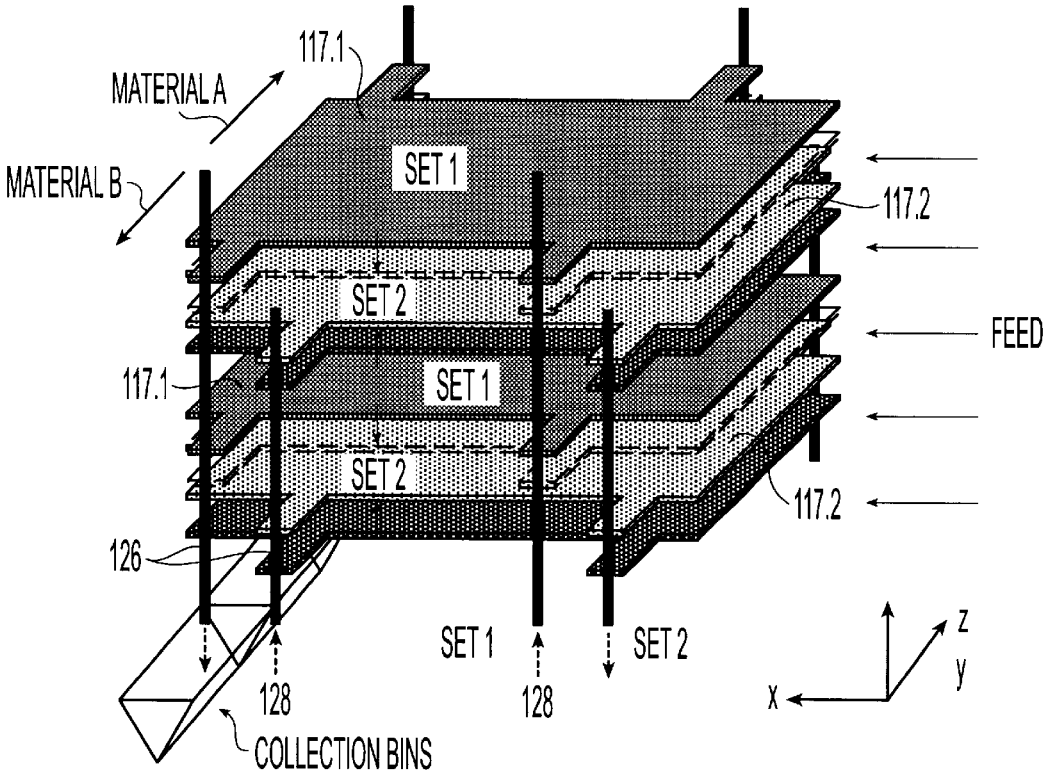

The FIG. 13 embodiment is a variant of the FIG. 11 embodiment. In this case, alternate electrode support structures 117.1, 117.2 are connected to one another by connectors 126. Thus there are, in effect, two groups of electrodes support structures with each group composed of alternate structures 117.1 or 117.2. As indicated by the arrows 128, the respective groups are subjected to vibrations which are 180° out of phase with one another. This has the result that adjacent structures 117.1 and 117.2 alternately move towards one another and away from one another.

In practice, a single vibrator mechanism generating two pulses exactly 180° out of phase with one another can be used to vibrate the respective groups of electrode support structures 117.1, 117.2.

Figure 14:
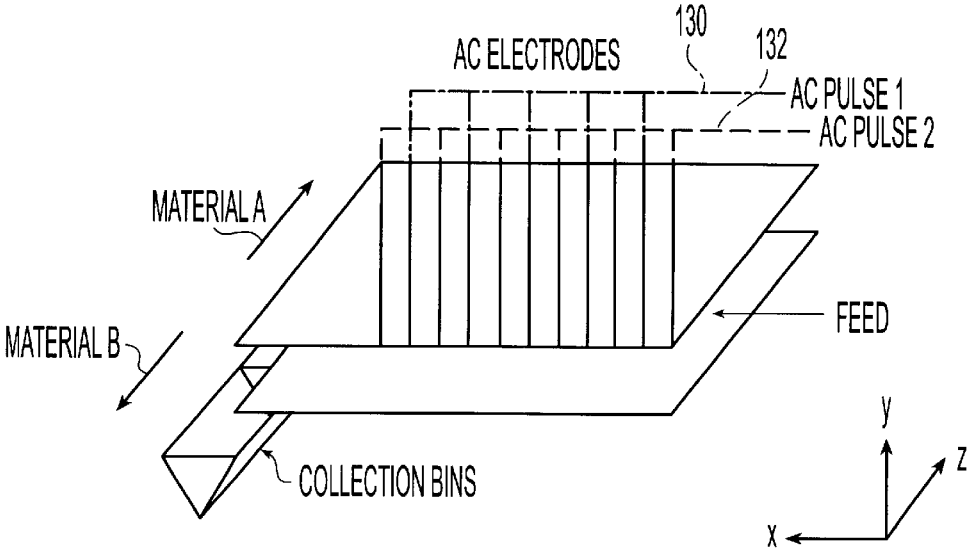
Figure 15:
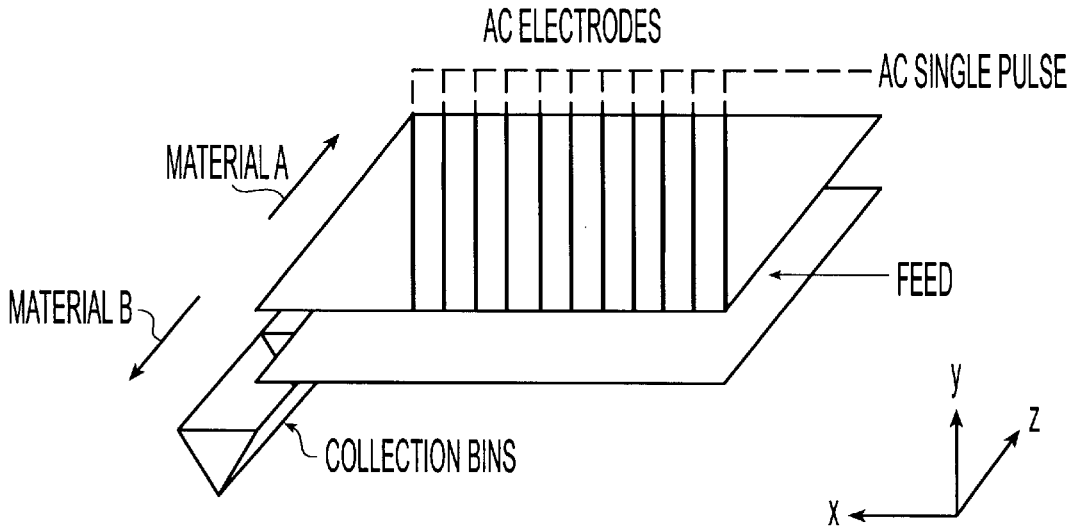

The electrodes 116 and their support structures 117 are arranged in FIG. 14 in the same manner as in FIG. 8. However in this case alternating currents of different polarity are applied to alternate electrodes as indicated by the chain-dot and broken lines 130 and 132.

The FIG. 15 embodiment is again similar in arrangement to that of FIG. 8. In this case, contrary to FIG. 14, a single alternating current is applied to all electrodes 116.

Figure 16:
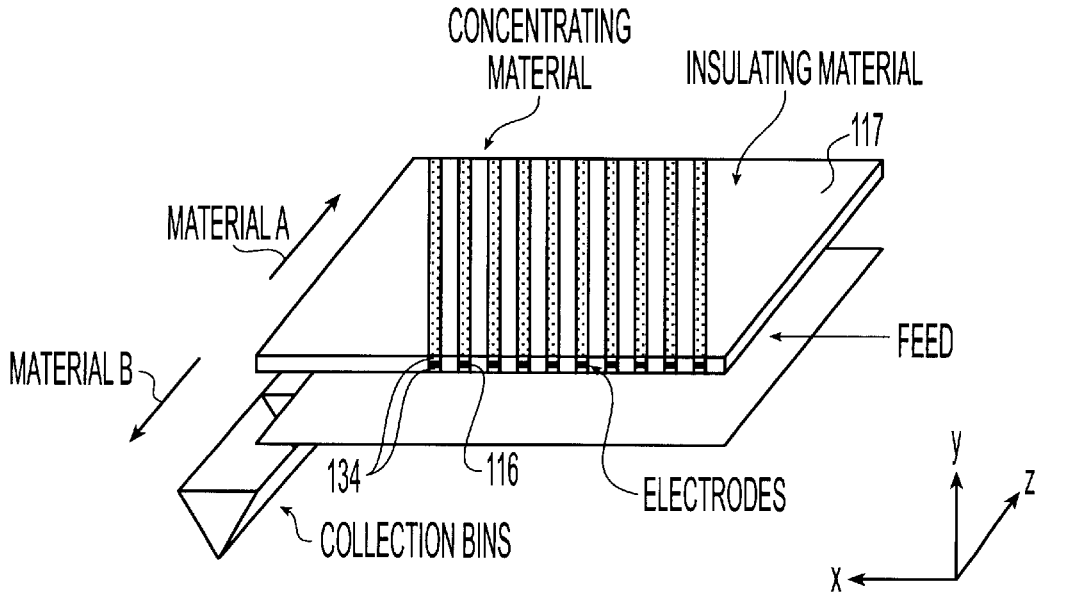

In FIG. 16 strips of concentrating material 134 are located above and below each conducting electrode 116 in the support structure 117. The concentrating material which has a high dielectric constant, acts to increase the strength and gradient of the electrical field generated by the electrodes and acting on the particles.

Figure 17:
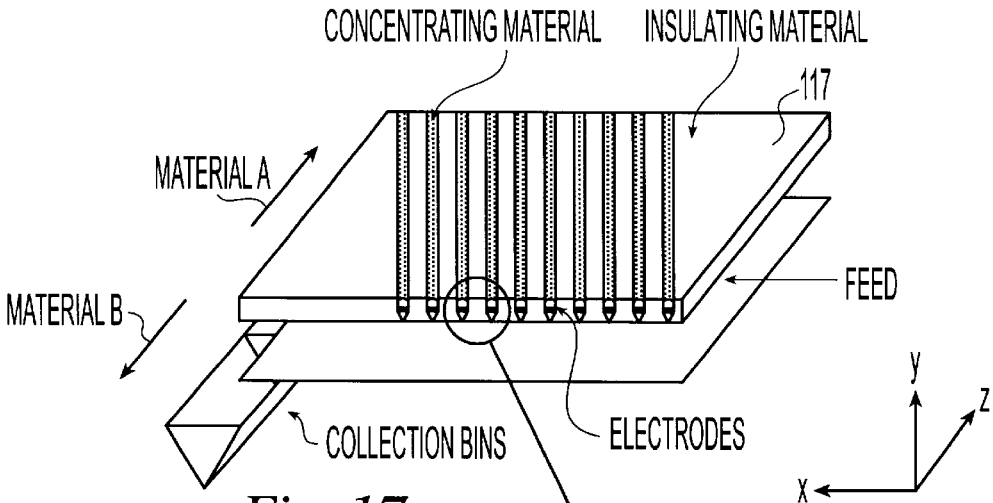
Figure 18:
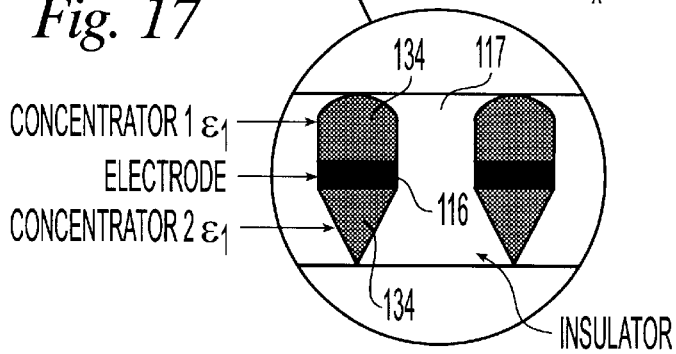

FIGS. 17 and 18 show another embodiment which makes use of strips 134 of concentrating material above and below each electrode 116. As illustrated, the electrodes 116 are in the form of thin strips, the strips of concentrating material above the electrodes have rounded upper edges and the strips of concentrating material below the electrodes have triangular cross-sections. The strips 134 are specifically shaped in order to modify the nature of the electrical field generated by the electrodes 116. The upper edges of the upper strips 134 are rounded to prevent charge concentrations in these zones and the possibility of resultant arcing.

Figure 19:
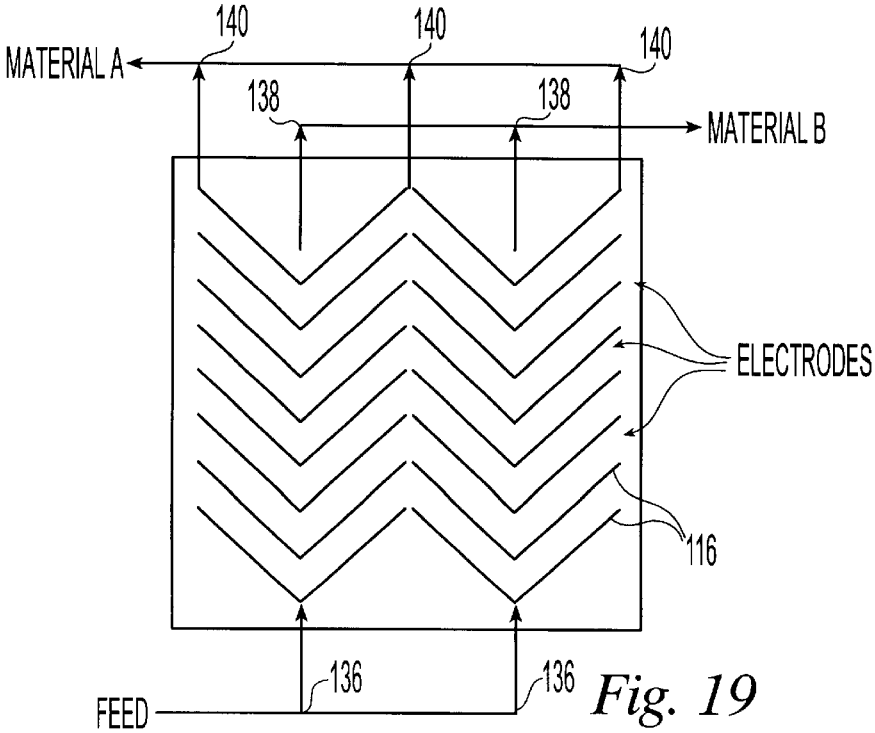

In FIG. 19, which shows apparatus of the invention in plan view, the electrodes 116 are arranged in a chevron-type configuration which is symmetrical about the centre line in the feed direction. As illustrated by the arrows in this Figure, feed is introduced at two points 136, material B, i.e. particles of lower dielectric constant, is collected at points 138, and material A, i.e. particles of high dielectric constant, is collected at points 140. The illustrated arrangement enables the apparatus to have a greater working width than would otherwise be possible, and thereby provides for a greater material throughput.

Figure 20:
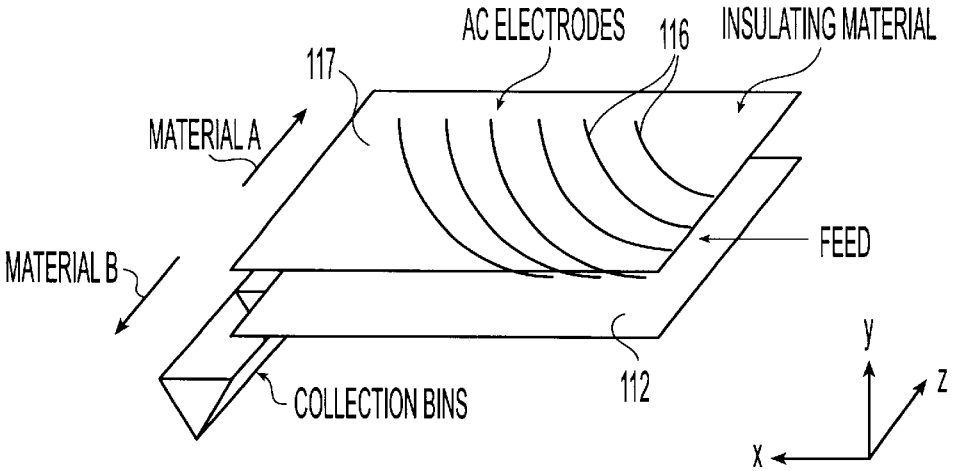

FIG. 20 shows an apparatus in which the electrodes 116 are arcuate in shape. As is also illustrated in this FIG., the electrodes need not be parallel to one another. With variations in the electrode shapes, as exemplified in this FIG., it is possible to vary the separation characteristics achieved with the apparatus.

Figure 21:
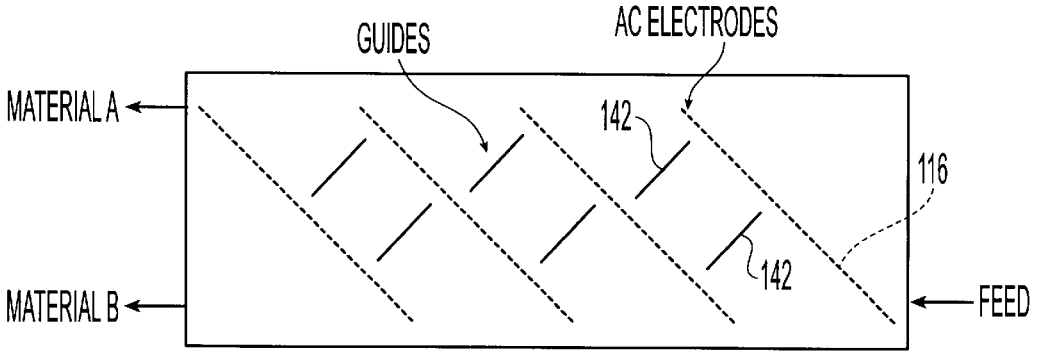

FIG. 21 shows a variant of FIG. 8 in which guides 142 are located at intervals in the path of movement of the particles. In practice, the guides are positioned to promote accurate separation of particles with higher and lower dielectric constants.

Figure 22:
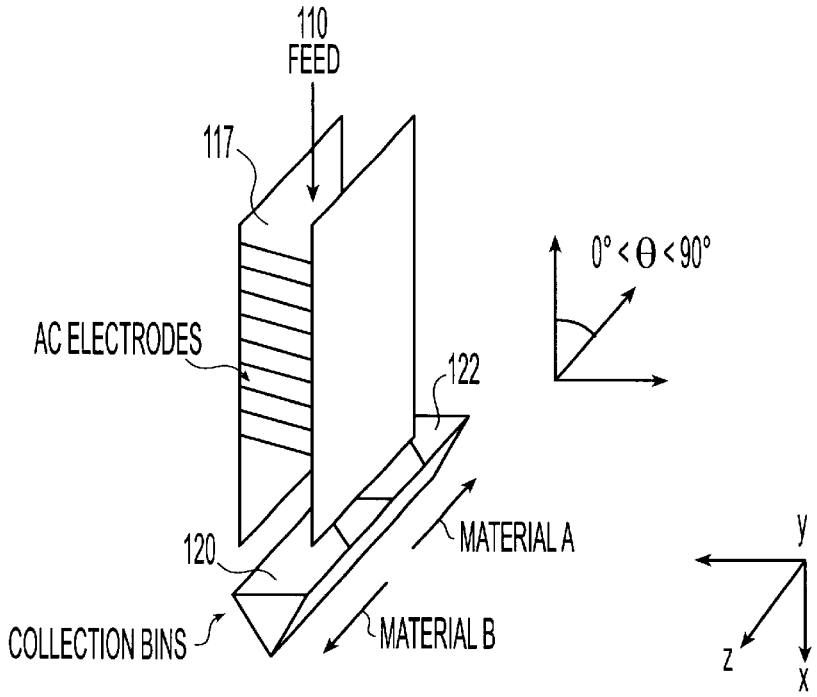

The FIG. 22 embodiment differs from previous embodiments in that the overall direction of particle movement is downwards. As in previous embodiments, material A, i.e. particles with higher dielectric constant, is diverted transversely from the feed direction to follow the electrode orientation.

Figure 23:
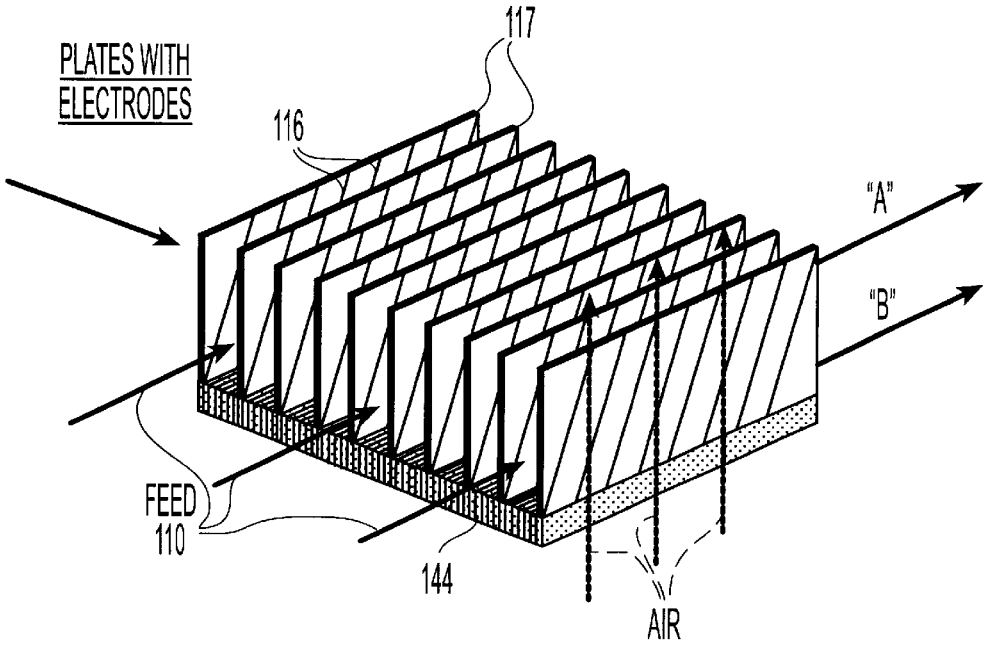

In FIG. 23 the particles move horizontally between electrode support structures 117 arranged vertically on edge as illustrated. In this case, material A is diverted upwardly to follow the orientation of the electrodes 116, whereas material B continues in the feed direction at a low level. Whereas in each of the previous embodiments the particles are agitated by vibration of the feeder tray and/or electrode support structure(s), agitation in this case is achieved by injecting pressurised air through a porous base plate 144 to create a fluidised bed effect to prevent particles with higher dielectric constant from "hanging up" adjacent the electrodes 116.

Figure 24:
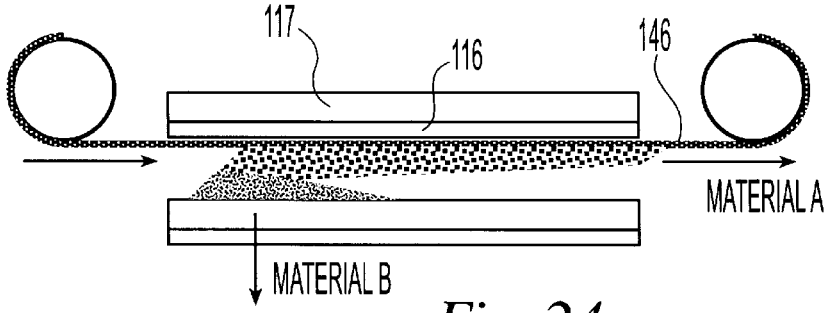

In FIG. 24, there is an endless polymer belt 146 on the underside of which material A, i.e. particles of higher dielectric constant, collects as a result of forces applied to it by electrodes 116 in a support structure 117 located above the belt. Material B is essentially unaffected and passes through for collection apart from material A.

Figure 25:
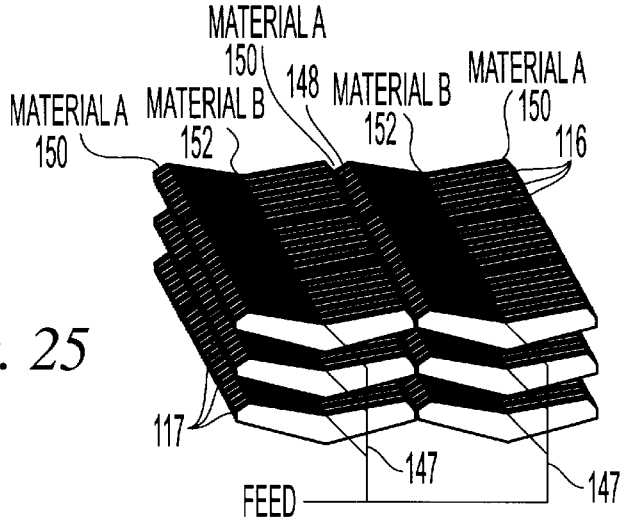

The FIG. 25 embodiment makes use of electrode support structures 117 connected in stacked sections as illustrated. Feed is introduced at points 147. As a result of the forces applied to it by the AC electrical field generated by the electrodes 116, material A is moved sideways into the grooves 148 between the support structures 117 and from these grooves is collected at points 150. Material B, on the other hand, remains in the trough-like lower portions of the structures 117 and moves in the feed direction for collection at points 152.

Figure 26:
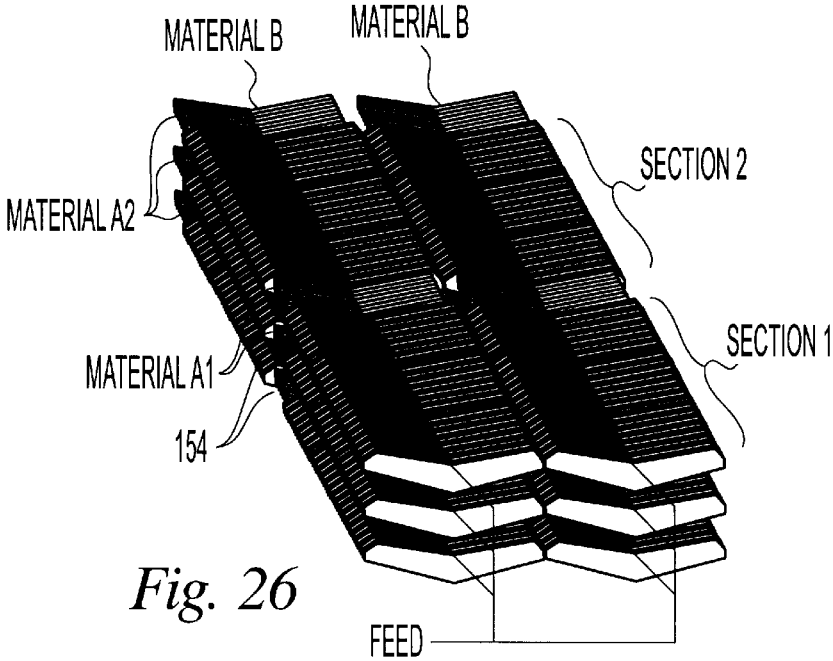

The FIG. 26 embodiment is generally similar in operation to the FIG. 25 embodiment. However in this case the grooves 148 are interrupted by collection points 154. With this arrangement it is possible to collect different fractions of material A, which themselves have different dielectric constants, at different points along the length of the support structure assembly. It will be understood that such an arrangement makes it possible to achieve separation of multi-component particle mixtures. The particles with the highest dielectric constant are collected as material Al, particles with lower dielectric constant as material A2 and particles with the lowest dielectric constant as material B.

Figure 31:
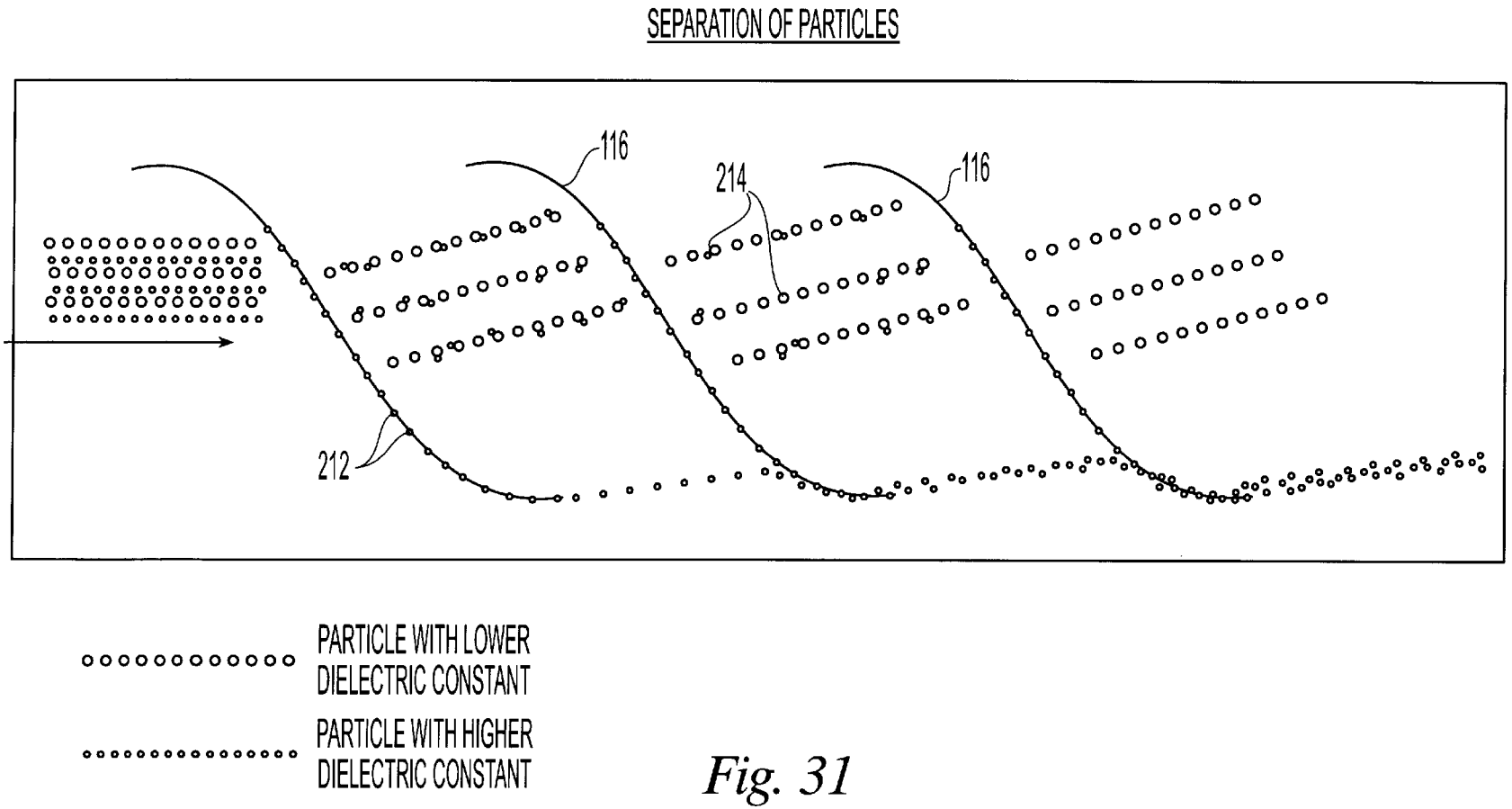

FIGS. 30 and 31 illustrate the principles underlying an arrangement similar to that of, say, FIG. 8. Here the electrodes 116 are curved as shown. The particles of material A, indicated with the numeral 212, tend to follow the curvature of the electrodes as a result of the ponderomotive forces acting on them, with applied vibrations moving them from the vicinity of the tail end of one electrode to the tail end of the next electrode. The particles 214 of material B are relatively undeflected by the first electrode 116 and move transversely towards successive electrodes, with further separation at each electrode of those particles having higher dielectric constant. Thus there tends after several electrodes to be a gradually increasing accumulation of particles with higher dielectric constant in the vicinity of the tail ends of the electrodes and a gradual reduction in particles of lower dielectric constant which are relatively undeflected. This is further illustrated in FIG. 30, in which FIGS. 30(*a*) to 30(*e*) indicate the ever increasing accumulation of particles of material A, i.e. with higher dielectric constant, adjacent the successive electrodes.

The invention as exemplified above in FIGS. 8 to 26 can, for instance, also in the separation of rutile ($TiO_2$) particles from zircon ($ZrSiO_2$) particles, or for the separation of sulphide minerals from oxide- and silicate gangue materials.

The successful application of electroadhesion technology, as described above, to a number of additional ores has also been demonstrated. An appreciable separation of malachite and pseudomalachite "oxidic" copper from gangue minerals such as quartz and mica has been performed using the technique of the invention. In addition, substantial beneficiations of vermiculite from pyroxene, apatite, quartz and phlogopite gangue have been achieved.

A feature of each of the embodiments of the invention described above is the fact that the method is carried out in air, with particle separation being achieved by appropriate selection and creation of the sharply nonhomogeneous fields. This is considered to be advantageous compared to known systems in which separation according to dielectric properties is carried out in an ambient liquid medium with attempts being made to achieve separation by varying the dielectric properties of the medium itself.

A further feature, common to all embodiments described above, is the fact that the electrical field through which the particles are passed is sharply nonhomogeneous in nature. This is achieved by ensuring that the electrical field has a gradient exceeding $10^8$ V/m$^2$, preferably exceeding $4\times10^9$ V/m$^2$, and a divergence. exceeding $10^{11}$, preferably exceeding $10^{12}$.

Although specific mention has been made of the separation of mineral particles in the embodiments described above, it will be appreciated that the principles of the invention are equally applicable to the separation of other, non-mineral particles.

We claim:

1. An apparatus for separating particles according to their dielectric properties, the apparatus comprising field generating means for generating a sharply non-homogeneous DC electrical field having a gradient exceeding $4\times10^9$ V/m$^2$ and a divergence exceeding $10^{12}$, feed means for feeding particles which are to be separated through the electrical field, the feed means comprising a feeder which discharges particles over a sharp edge thereof, the radius of the edge being in the range of 0.01 and 1 times the average particle diameter, such that particles with different dielectric properties are acted upon by different forces which separate them spatially, collection means for separately collecting the spatially separated particles wherein the feed means comprises a feeder, at earth potential, which discharges the particles over the sharp edge thereof to fall under gravity through the sharply non-homogenous DC electrical field which is set up between a main space DC electrode, located adjacent the path of the falling particles, and the edge, and discrete collectors are located generally beneath the feeder edge to collect spatially separated particles.

2. An apparatus according to claim 1 wherein the particles have an average particle diameter and the radius of the edge is in the range 0,01 to 0,1 times the a average particle diameter.

3. An apparatus according to claim 1 wherein the particles have an average particle diameter and the radius of the edge is in the range 0,01 to 0,5 time the average particle diameter.

4. An apparatus according to claim 1 wherein the feeder is a vibratory feeder.

5. An apparatus according to claim 1 comprising a further DC electrode situated further than the main space electrode along the path of the particles discharged from the edge of the feeder.

6. An apparatus according to claim 5 comprising one or more further electrodes to which an AC potential or combined AC and DC potentials are applied, such further electrodes serving to condition the particles prior to their passage through the sharply non-homogeneous DC field.

7. An apparatus according to claim 6 comprising a further electrode, to which an AC potential or combined AC and DC potentials are applied, situated above the feeder in the vicinity of the edge thereof.

8. An apparatus according to claim 7 comprising a further electrode, to which an AC potential or combined AC and DC potentials are applied, situated below the feeder in the vicinity of the edge thereof.

9. An apparatus according to claim 1 comprising a layer of insulating material on the feeder.

10. An apparatus according to claim 1 comprising a disagglomerating mesh through which the particles are passed prior to their passage through the sharply non-homogeneo us electrical field.

11. An apparatus according to claim 1 comprising means for fluidising the particles in a flow of air.

12. An apparatus according to claim 1 comprising means for vibrating a electrode support structure.

13. An apparatus according to claim 12 comprising a plurality of electrode support structures located in spaced apart relationship with gaps between them, the feed means being arranged to pass the particles through the gaps.

14. An apparatus according to claim 12 wherein the electrode support structures are horizontally oriented.

15. An apparatus according to claim 12 wherein the electrode support structures are inclined acutely to the horizontal.

16. An apparatus according to claim 12 wherein the electrode support structures are generally vertically oriented.

17. An apparatus according to claim 6 wherein any or all of the electrodes are curved.

18. An apparatus according to claim 6 wherein any or all of the electrodes are covered with a dielectric material.

19. An apparatus according to claim 6 wherein the electrodes are arranged in a chevron format.

20. An apparatus according to claim 6 wherein the electrodes are located on one side of a moving belt and the material is passed adjacent the opposite side of the belt, the arrangement being such that particles with a higher dielectric constant are held to the belt by electro-adhesive forces generated therein by the non-homogenous electrical field.

21. An apparatus according to claim 1 when used to separate rutile particles from zircon particles.

22. A method of separating particles according to their dielectric properties, comprising the steps of passing particles which are to be separated through a sharply non-homogeneous electrical field, in a non-liquid medium, the electrical field having a gradient exceeding $10^8$ V/m$^2$ and a divergence exceeding $10^{11}$, and wherein the particles are discharged over a sharp edge and pass through a sharply non-homogeneous field set up between one or more DC electrodes and the sharp edge, the sharp edge having a radius in the range of 0.01 to 1 times the average particle diameter, whereby particles with different dielectric properties are acted upon by different forces which separate them spatially, and collecting the spatially separated particles in discrete fractions, and including the steps of holding the feeder at earth potential and applying a DC potential to a main space electrode situated adjacent the path of the particles as they are discharged over the edge of the feeder, thereby to set up the sharply non-homogeneous DC electrical field between the main space electrode and the edge.

23. A method according to claim 22 including the step of applying a DC potential to a further electrode situated further than the main space electrode along the path of the particles discharged from the edge of the feeder.

24. A method according to claim 22 including the step of conditioning the particles, prior to passage through the non-homogeneous DC electrical field, in an AC electrical field created by application of an AC potential to an electrode or electrodes situated above and/or below the feeder in the vicinity of the edge.

25. A method according to claim 22 wherein the feeder is a vibratory feeder.

26. A method according to claim 22 including the step of collecting spatially separated particles in discrete collectors located generally beneath the edge of the feeder.

27. A method according to claim 22 including the step of insulating the particles from the feeder by a layer of insulating material on the feeder.

28. A method according to claim 22 including the step of passing the particles through a mesh which disagglomerates them prior to passage through the sharply non-homogeneous electrical field.

29. A method according to claim 22 including the steps of passing the particles through a sharply non-homogeneous, high frequency AC electrical field and separating them according to their dielectric properties.

30. A method according to claim 29 including the step of setting up the AC electrical field by AC electrodes which are spaced apart from one another by insulating material in an electrode support structure.

31. A method according to claim 30 including the step of arranging the electrodes parallel to one another in an electrode support structure and at an incline relative to a feed direction in which the particles are introduced to the electrode structure.

32. A method according to claim 31 including the step of passing the particles above or below the electrode support structure on a feeder.

33. A method according to claim 30 including the step of vibrating the electrode support structure.

34. A method according to claim 30 including the step of fluidizing the particles by a flow of air.

35. A method according to claim 30 including the step of collecting spatially separated particles in spaced apart collectors situated adjacent the electrode support structure.

36. A method according to claim 22 which is carried out in a gaseous medium.

37. A method according to claim 26 which is carried out in air.

38. A method according to claim 22 including the step of separating ratile particles from zircon particles.

* * * * *

UNITED STATES PATENT AND TRADEMARK OFFICE

CERTIFICATE OF CORRECTION

PATENT NO. : 6,390,302 B1
DATED : May 21, 2002
INVENTOR(S) : Abrarov et al.

It is certified that error appears in the above-identified patent and that said Letters Patent is hereby corrected as shown below:

Column 11,
Line 32, amend the second line of claim 12 by changing “a” to -- the --.

Column 12,
Line 63, amend the second line of claim 38 by changing “ratile” to -- rutile --.

Signed and Sealed this

Third day of September, 2002

*Attest:*

*Attesting Officer*

JAMES E. ROGAN
*Director of the United States Patent and Trademark Office*